US010634168B2

(12) United States Patent
Kono et al.

(10) Patent No.: US 10,634,168 B2
(45) Date of Patent: Apr. 28, 2020

(54) BLOWER AND AIR-CONDITIONING APPARATUS INCLUDING THE SAME

(71) Applicant: Mitsubishi Electric Corporation, Tokyo (JP)

(72) Inventors: Atsushi Kono, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 129 days.

(21) Appl. No.: 15/753,215

(22) PCT Filed: Oct. 7, 2015

(86) PCT No.: PCT/JP2015/078486

§ 371 (c)(1),
(2) Date: Feb. 16, 2018

(87) PCT Pub. No.: WO2017/060987

PCT Pub. Date: Apr. 13, 2017

(65) Prior Publication Data

US 2018/0238351 A1 Aug. 23, 2018

(51) Int. Cl.

| | |
|---|---|
| ***F04D 29/30*** | (2006.01) |
| ***F04D 29/66*** | (2006.01) |
| ***F04D 29/28*** | (2006.01) |

(52) U.S. Cl.

CPC ..... *F04D 29/666* (2013.01); *F04D 29/281* (2013.01); *F04D 29/283* (2013.01); *F04D 29/30* (2013.01)

(58) Field of Classification Search

None

See application file for complete search history.

(56) References Cited

U.S. PATENT DOCUMENTS 4,929,149 A * 5/1990 Greenspan ..... F04D 17/162 415/93
5,044,887 A * 9/1991 Duthie ..... F04D 29/281 209/154

(Continued)

FOREIGN PATENT DOCUMENTS

| | | | |
|---|---|---|---|
| JP | H09-195988 | A | 7/1997 |
| JP | 2001-271791 | A | 10/2001 |
| JP | 2006-070883 | A | 3/2006 |

OTHER PUBLICATIONS

International Search Report of the International Searching Authority dated Dec. 22, 2015 for the corresponding international application No. PCT/JP2015/078486 (and English translation).

*Primary Examiner* — Michael Lebentritt
(74) *Attorney, Agent, or Firm* — Posz Law Group, PLC

(57) ABSTRACT

A blower includes a volute shaped casing having an air inlet, and an impeller including a disk-shaped backing plate, a ring-shaped rim, and a plurality of blades supported between the backing plate and the rim. The impeller is housed in the casing. Each of the blades includes a first blade segment adjacent to the backing plate, and a second blade segment provided between the first blade segment and the rim. Each of the blades has a blade outlet angle at a trailing edge of the second blade segment different from a blade outlet angle at a trailing edge of the first blade segment. At least one of a pressure surface of the second blade segment and a suction surface of the second blade segment includes a flat surface extending toward a leading edge of the second blade segment from the trailing edge of the second blade segment.

16 Claims, 7 Drawing Sheets

(56) References Cited

U.S. PATENT DOCUMENTS

| | | | | |
|---|---|---|---|---|
| 5,141,397 | A * | 8/1992 | Sullivan | F04D 29/4233 285/319 |
| 5,152,661 | A * | 10/1992 | Sheets | F01D 5/145 415/84 |
| 7,173,353 | B2 * | 2/2007 | Lopatinsky | F04D 25/066 310/268 |
| 8,007,243 | B2 * | 8/2011 | Arinaga | F04D 29/384 415/119 |
| 9,567,942 | B1 * | 2/2017 | Krivitzky | F02K 1/36 |
| 2005/0217673 | A1 * | 10/2005 | Daly | A61M 16/0057 128/204.18 |
| 2007/0201976 | A1 | 8/2007 | Higashida | |
| 2007/0237626 | A1 * | 10/2007 | Pouysegur | F04D 25/082 415/144 |
| 2012/0199129 | A1 * | 8/2012 | Kenyon | A61M 16/0066 128/205.25 |
| 2013/0259669 | A1 * | 10/2013 | Tadokoro | F04D 17/04 415/185 |
| 2013/0266434 | A1 * | 10/2013 | Blackburn | F04D 23/008 415/208.1 |
| 2014/0314592 | A1 * | 10/2014 | Keon | F04D 25/06 417/410.1 |
| 2017/0130723 | A1 * | 5/2017 | Kosaka | F04D 29/4226 |
| 2018/0087527 | A1 * | 3/2018 | Dossner | F04D 19/002 |
| 2019/0136866 | A1 * | 5/2019 | Kedelty | F04D 17/162 |
| 2019/0178251 | A9 * | 6/2019 | Daly | A61M 16/0057 |

* cited by examiner

BLOWER AND AIR-CONDITIONING APPARATUS INCLUDING THE SAME

CROSS REFERENCE TO RELATED APPLICATION

This application is a U.S. national stage application of International Application No. PCT/JP2015/078486, filed on Oct. 7, 2015, the contents of which are incorporated herein by reference.

TECHNICAL FIELD

The present invention relates to a blower and an air-conditioning apparatus including the blower.

BACKGROUND

A multi-blade centrifugal fan including a volute shaped casing is an example of a known blower. The multi-blade centrifugal fan includes an impeller that has many blades at the periphery thereof and that is rotatably disposed in the volute shaped casing. Outside air is sucked into the impeller through an air inlet that opens in a side surface of the volute shaped casing. The air is discharged from the impeller that rotates through spaces between the blades in the volute shaped casing, and is blown an air outlet of the volute shaped casing. The impeller includes a disk-shaped backing plate adjacent to a motor, a ring-shaped rim adjacent to the air inlet of the volute shaped casing, and a plurality of blades that connect the backing plate and the rim (see, for example, Patent Literature 1).

PATENT LITERATURE

Patent Literature 1: Japanese Unexamined Patent Application Publication No. 2006-70883

In the above-described multi-blade centrifugal fan, air flows into the impeller from one side of the impeller, that is, from the rim side. Accordingly, the angle at which the air flows into the spaces between the blades differs between the rim side and the backing-plate side of the impeller. The angle at which the air flows out of the spaces between the blades also differs between the rim side and the backing-plate side of the impeller.

Accordingly, when rim-side portions and backing-plate-side portions of the blades have the same shape, separation of air flow from the blade surfaces occurs at the rim side or the backing-plate side of the blades. The separation of air flow not only generates noise but causes a large reduction in blowing efficiency.

SUMMARY

The present invention has been made in light of the above-described circumstances, and an object of the present invention is to provide a blower with less noise and increased blowing efficiency by adjusting the shape of blades of an impeller included in the blower to prevent separation of air flow from the blade surfaces, and to provide an air-conditioning apparatus including the blower.

A blower according to an embodiment of the present invention includes a volute shaped casing having an air inlet, and an impeller including a disk-shaped backing plate, a ring-shaped rim, and a plurality of blades supported between the backing plate and the rim. The impeller is housed in the casing. Each of the blades includes a first blade segment adjacent to the backing plate, and a second blade segment provided between the first blade segment and the rim. Each of the blades has a blade outlet angle at a trailing edge of the second blade segment being different from a blade outlet angle at a trailing edge of the first blade segment. At least one of a pressure surface of the second blade segment and a suction surface of the second blade segment including a flat surface extending toward a leading edge of the second blade segment from the trailing edge of the second blade segment.

In the blower according to the embodiment of the present invention, the blade outlet angle at the trailing edge of the second blade segment is different from the blade outlet angle at the trailing edge of the first blade segment, and at least one of the pressure surface of the second blade segment and the suction surface of the second blade segment includes the flat surface extending from the trailing edge of the second blade segment. Accordingly, the air flow is not easily separated from the blades, and disturbance of the air flow is reduced. As a result, the blower can be improved in terms of efficiency, and noise thereof can be reduced.

DETAILED DESCRIPTION

Figure 1:
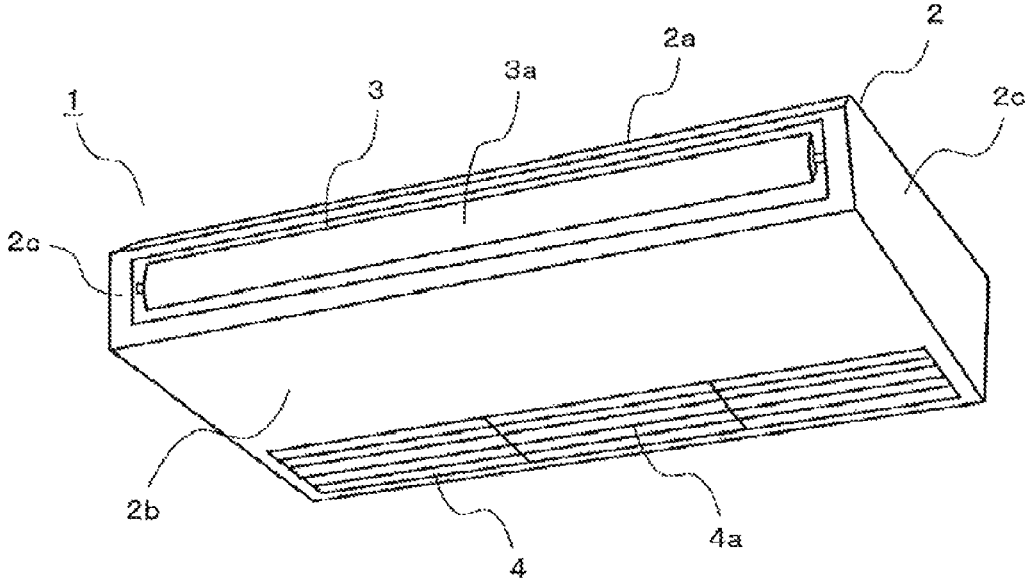
FIG. 1 is a perspective view of an indoor unit of an air-conditioning apparatus in which a multi-blade centrifugal fan according to Embodiment 1 is mounted.

A multi-blade centrifugal fan will be described with reference to the drawings as example of a blower according to the present invention.

The structures, operations, etc. described below are merely examples, and a blower according to the present invention is not limited to the structures, operations, etc. described below. In the figures, the same or similar elements are denoted by the same reference numerals or illustrated without reference numerals. Also, detailed structures are simplified or omitted as appropriate. In addition, redundant or similar description is simplified or omitted.

Although an example in which a blower according to the present invention is applied to an air-conditioning apparatus will be described, the blower is not limited to this, and may instead be applied to, for example, a ventilation device or an air-sending apparatus in general.

Embodiment 1

An air-conditioning apparatus 1 according to Embodiment 1 will be described with reference to FIGS. 1 and 2.

FIG. 1 is a perspective view of an indoor unit of an air-conditioning apparatus in which a multi-blade centrifugal fan according to Embodiment 1 is mounted.

Figure 2:
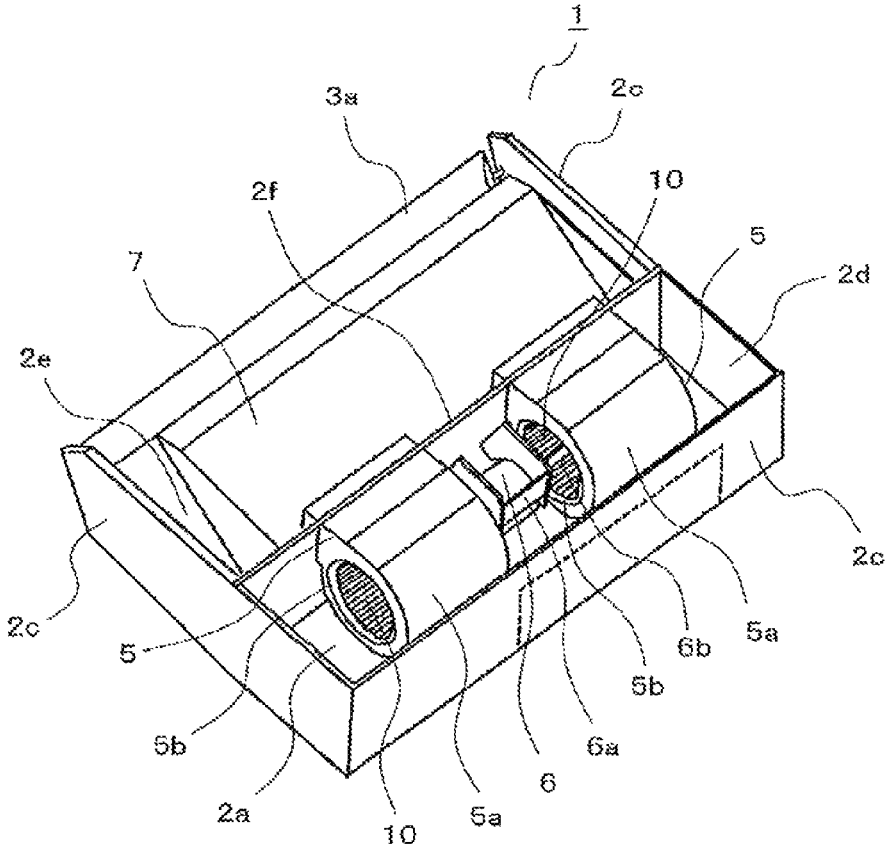
FIG. 2 is a perspective view illustrating the internal structure of the air-conditioning apparatus according to Embodiment 1.

FIG. 2 is a perspective view illustrating the internal structure of the air-conditioning apparatus according to Embodiment 1.

<Structure of Air-Conditioning Apparatus 1>

The air-conditioning apparatus 1 includes a casing 2 mounted on a ceiling above an air-conditioned space. The casing 2 is, for example, rectangular parallelepiped shaped. The casing 2 includes an upper panel 2*a*, a lower panel 2*b*, and four side panels 2*c*.

An air outlet 3, which is, for example, rectangular, opens in one of the four side panels 2*c*. A vane 3*a* capable of adjusting the direction of air flow in, for example, the up-down and left-right directions is disposed in the air outlet 3.

An air inlet 4, which is, for example, rectangular, opens in the lower panel 2*b*. A suction grille 4*a* is disposed in the air inlet 4. A filter (not shown) that removes dust from air that has passed through the suction grille 4*a* is disposed in the casing 2 on the inner side of the suction grille 4*a*.

The casing 2 of the air-conditioning apparatus 1 houses multi-blade centrifugal fans 5, a fan motor 6, and a heat exchanger 7. Each multi-blade centrifugal fan 5 includes a volute shaped casing 5*a*, a bell mouth 5*b* formed in an air inlet of the volute shaped casing 5*a*, and a cylindrical impeller 10 that is rotatably disposed in the volute shaped casing 5*a*.

The fan motor 6 is supported by a motor support 6*a* fixed to the lower panel 2*b* of the casing 2. The fan motor 6 rotates a rotation shaft 6*b* of the impeller 10 of each multi-blade centrifugal fan 5.

The heat exchanger 7 is disposed in a flow path of the air blown by the multi-blade centrifugal fans 5, and exchanges heat between a heat medium that flows through a heat transfer pipe (not shown) of the heat exchanger 7 and the air.

The volute shaped casings 5*a* of the multi-blade centrifugal fans 5 are arranged to surround the respective impellers 10, and regulate the flow of air discharged from the impellers 10. The bell mouths 5*b*, which are formed in the air inlets of the volute shaped casings 5*a*, regulate the flow of air introduced into the multi-blade centrifugal fans 5. A suction-side space 2*d* in the casing 2, which communicates with the bell mouths 5*b*, and a discharge-side space 2*e* in the casing 2, which communicates with air outlets of the volute shaped casings 5*a*, are partitioned from each other by a partitioning plate 2*f*.

The air-conditioning apparatus 1 is configured such that air in the air-conditioned space is sucked into the casing 2 through the air inlet 4 when the impellers 10 are rotated. The air sucked into the casing 2 is sucked into the volute shaped casings 5*a* of the multi-blade centrifugal fans 5 through the bell mouths 5*b*. The air sucked into the volute shaped casings 5*a* is discharged outward in the radial direction of the impellers 10 due to the rotation of the impellers 10. The discharged air is compressed between the impellers 10 and the inner walls of the volute shaped casings 5*a* so that the total pressure thereof increases. The air discharged from the volute shaped casings 5*a* passes through the heat exchanger 7 so that the temperature and humidity thereof are adjusted, and is then supplied to the air-conditioned space through the air outlet 3 in the air-conditioning apparatus 1.

The details of the multi-blade centrifugal fan 5 according to Embodiment 1 will now be described with reference to FIGS. 3 and 4.

Figure 3:
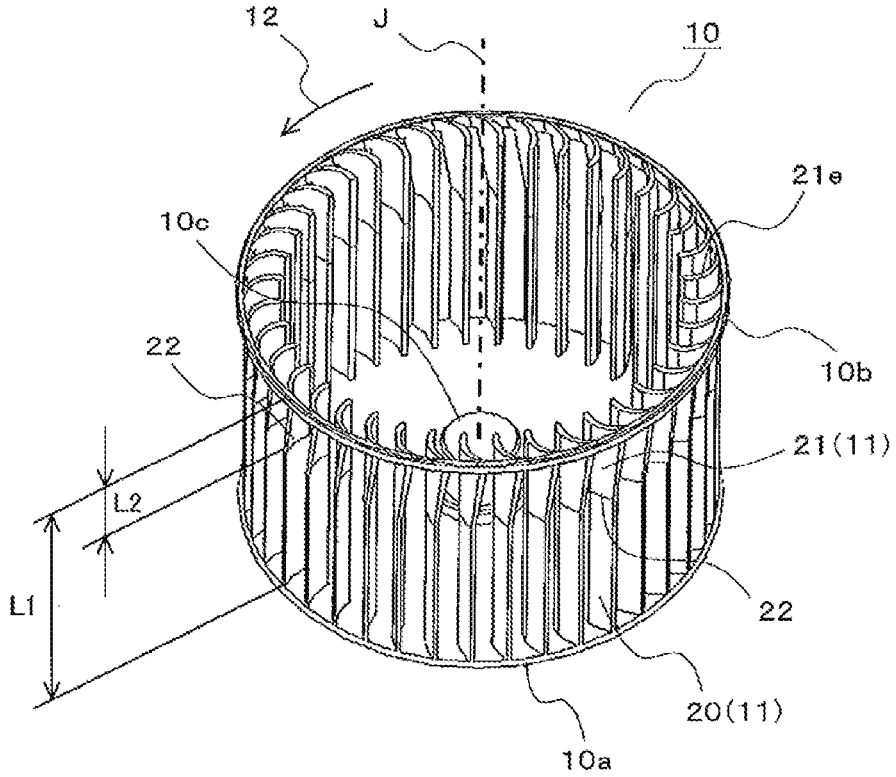
FIG. 3 is a perspective view of an impeller according to Embodiment 1.

FIG. 3 is a perspective view of an impeller according to Embodiment 1.

Figure 4:
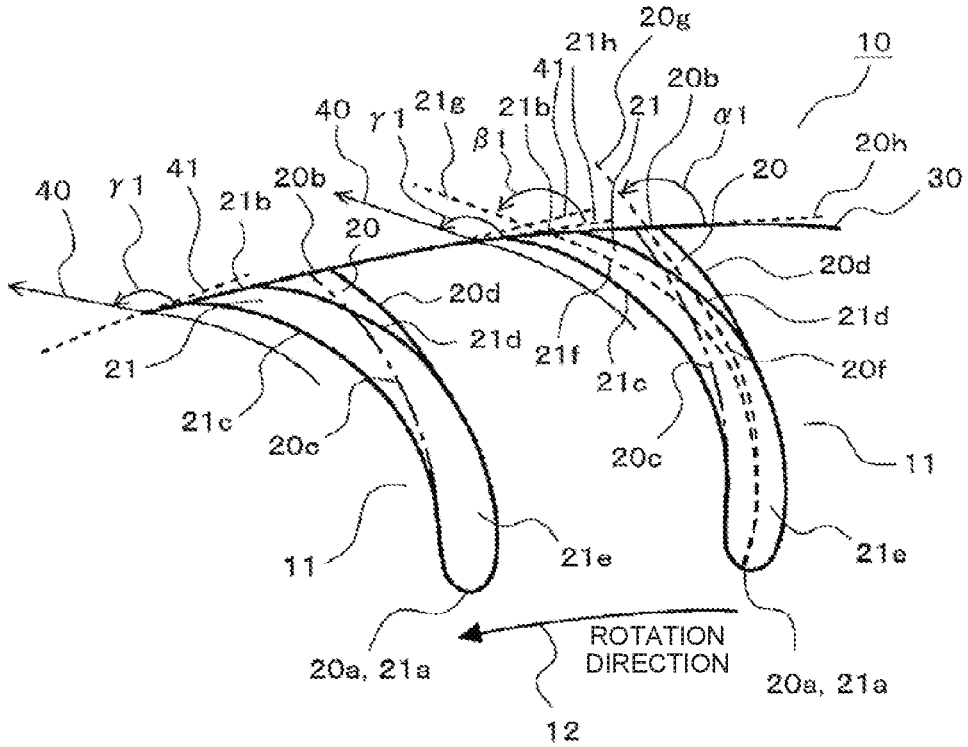
FIG. 4 is an enlarged view of blades according to Embodiment 1, viewed from a rim in a direction of a rotation axis J.

FIG. 4 is an enlarged view of blades according to Embodiment 1, viewed from a rim in a direction of a rotation axis J.

<Structure of Impeller 10>

As illustrated in FIG. 3, the impeller 10 of each multi-blade centrifugal fan 5 has a cylindrical shape and includes a disk-shaped backing plate 10*a* and a ring-shaped rim 10*b* that extend in parallel and oppose each other. The impeller 10 rotates around the rotation axis J in a rotation direction 12.

A plurality of blades 11 extend parallel to the rotation axis J between the outer periphery of the backing plate 10*a* and the rim 10*b*. The blades 11 are arranged to surround the rotation axis J of the impeller 10.

The backing plate 10*a* includes a boss portion 10*c* on the rotation axis J. The boss portion 10*c* is connected to the rotation shaft 6*b* of the fan motor 6.

The impeller 10 is attached to the volute shaped casing 5*a* so that the rim 10*b* opposes the bell mouth 5*b*. Accordingly, the air sucked into the volute shaped casing 5*a* through the bell mouth 5*b* flows into the impeller 10 from the side where the rim 10*b* is disposed.

The impeller 10 may either be formed in one piece by resin molding, or be formed by separately preparing the backing plate 10*a*, the rim 10*b*, and the blades 11 and assembling them together. The impeller 10 may be made of any appropriate material selected from, for example, resins and various types of metals.

<Structure of Blades 11>

The plurality of blades 11 have the same shape. As illustrated in FIG. 3, each blade 11 includes a first blade segment 20 adjacent to the backing plate 10*a* and a second blade segment 21 adjacent to the rim 10*b*. The first blade segment 20 and the second blade segment 21 may either be formed in one piece or be formed separately and combined together. The first blade segment 20 and the second blade segment 21 are connected to each other at a connecting portion 22.

As illustrated in FIG. 4, when each blade 11 is viewed in the direction of the rotation axis J, the first blade segment 20 and the second blade segment 21 have different attachment angles.

The first blade segment 20 is formed of a plate-shaped body that is parallel to the rotation axis J, and has a forward curved shape.

The second blade segment 21 is twisted from an end surface 21*e* adjacent to the rim 10*b* to be connected to the first blade segment 20.

As illustrated in FIG. 3, the length L1 of each blade 11 in the direction of the rotation axis J and the length L2 of the second blade segment 21 in the direction of the rotation axis J (length between the end surface 21*e* and the connecting portion 22) are set so that L2/L1 is less than or equal to ½.

The first blade segment 20 has a leading edge 20*a* at one end thereof at the inner periphery of the impeller 10, and a trailing edge 20*b* at the other end thereof at the outer periphery of the impeller 10. The first blade segment 20 also has a pressure surface 20*c*, which is a blade surface facing in the rotation direction 12, and a suction surface 20*d*, which is a blade surface facing in the direction opposite to the rotation direction 12.

The second blade segment 21 has a leading edge 21*a* at one end thereof at the inner periphery of the impeller 10, and a trailing edge 21*b* at the other end thereof at the outer periphery of the impeller 10. The second blade segment 21 also has a pressure surface 21*c*, which is a blade surface facing in the rotation direction 12, and a suction surface 21*d*, which is a blade surface facing in the direction opposite to the rotation direction 12.

As illustrated in FIG. 4, the first blade segment 20 and the second blade segment 21 are formed so that, in a cross section perpendicular to the rotation axis J, the pressure surfaces 20*c* and 21*c* are concave surfaces including arcs and the suction surfaces 20*d* and 21*d* are convex surfaces including arcs. The trailing edges 20*b* and 21 *b* are in front of the leading edges 20*a* and 21*a* in the rotation direction 12. This shape of the blade 11 is defined as a forward curved shape, and is commonly used as the shape of blades of a sirocco fan.

<First-Blade-Segment Outlet Angle α1 and Second-Blade-Segment Outlet Angle β1>

The definition of a first-blade-segment outlet angle α1 and a second-blade-segment outlet angle β1 at the trailing edges 20*b* and 21*b* will now be described.

As illustrated in FIG. 4, the first-blade-segment outlet angle α1 is defined as the angle between a tangent 20*g* of a first-blade-segment center line 20*f*, which passes through the center of the first blade segment 20 in the thickness direction, and a tangent 20*h* of a first imaginary circle 30, along which the trailing edge 20*b* moves, at the trailing edge 20*b*. Referring to FIG. 4, the first-blade-segment outlet angle α1 is the counterclockwise rotation angle from the tangent 20*h* of the first imaginary circle 30 to the tangent 20*g* of the first-blade-segment center line 20*f*.

As illustrated in FIG. 4, the second-blade-segment outlet angle β1 is defined as the angle between a tangent 21*g* of a second-blade-segment center line 21*f*, which passes through the center of the second blade segment 21 in the thickness direction, and a tangent 21*h* of the first imaginary circle 30, along which the trailing edge 21*b* moves, at the trailing edge 21*b*. Referring to FIG. 4, the second-blade-segment outlet angle β1 is the counterclockwise rotation angle from the tangent 21*h* of the first imaginary circle 30 to the tangent 21*g* of the second-blade-segment center line 21*f*.

The first-blade-segment outlet angle α1 is constant in the direction of the rotation axis J. The second-blade-segment outlet angle β1 is at a maximum at the end surface 21*e*, and gradually decreases to the first-blade-segment outlet angle α1 with increasing distance toward the connecting portion 22 between the second blade segment 21 and the first blade segment 20. In other words, the second-blade-segment outlet angle β1 is constantly greater than the first-blade-segment outlet angle α1. The angle difference between the first-blade-segment outlet angle α1 and the second-blade-segment outlet angle β1 is less than or equal to 20 degrees.

The trailing edge 21*b* of the second blade segment 21 is in front of the trailing edge 20*b* of the corresponding first blade segment 20 in the rotation direction 12.

<Air Flow>

Flow of air in the impeller 10 will now be described.

First, the definition of an air discharge angle γ1 will be described.

As illustrated in FIG. 4, the air discharge angle γ1 is defined as the angle between the direction in which discharged air 40 flows at the first imaginary circle 30, along which the trailing edges 20*b* and 21*b* move, and a tangent 41 of the first imaginary circle 30.

In general, in a multi-blade centrifugal fan (sirocco fan) having forward-curved-shaped blades, the discharge angle γ1 is small at a part of each blade 11 near the backing plate 10*a* and large at a part of each blade 11 on the side of the rim 10*b*.

When each blade 11 has a constant outlet angle in the direction of the rotation axis J, the blade 11 is designed to reduce the difference between the first-blade-segment outlet angle α1 of the blade 11 and the discharge angle γ1 at the part of the blade 11 near the backing plate 10*a* to prevent separation of the air flow from the surface of the blade 11.

In this case, since the blade 11 has a constant outlet angle in the direction of the rotation axis J, the difference between the second-blade-segment outlet angle β1 of the blade 11 and the discharge angle γ1 is increased at the part of the blade 11 on the side of the rim 10*b*, where the discharge angle γ1 is large. Therefore, the air flow is easily disturbed at the part of the blade 11 on the side of the rim 10*b*, and a pressure loss increases due to separation of the air flow from the blade 11.

In contrast, in the multi-blade centrifugal fan 5 according to Embodiment 1, the second-blade-segment outlet angle β1 of the second blade segment 21 adjacent to the rim 10*b* is greater than the first-blade-segment outlet angle α1 of the first blade segment 20 adjacent to the backing plate 10*a*. Therefore, the difference between the second-blade-segment outlet angle β1 and the discharge angle γ1 is reduced.

<Effects>

In the multi-blade centrifugal fan 5 according to Embodiment 1, the first-blade-segment outlet angle α1 and the second-blade-segment outlet angle β1 are adjusted in consideration of the difference in the air discharge angle γ1 between the part of the blade 11 near the backing plate 10*a* and the part of the blade 11 on the side of the rim 10*b*. Accordingly, separation of the air flow does not occur over the entire surface of the blade 11.

In other words, the second-blade-segment outlet angle β1 of the second blade segment 21 adjacent to the rim 10*b* is set to be greater than the first-blade-segment outlet angle α1 of the first blade segment 20 adjacent to the backing plate 10*a*, so that the difference between the second-blade-segment outlet angle β1 and the discharge angle γ1 is reduced.

Accordingly, separation of the air flow is reduced, particularly at the second blade segment 21, and disturbance of the air flow is reduced. As a result, the multi-blade centrifugal fan 5 can be improved in terms of efficiency, and noise thereof can be reduced.

The air flow velocity is higher and the discharge angle γ1 is more stable at the first blade segment 20 of the blade 11 than at the second blade segment 21, and therefore the first blade segment 20 contributes to increasing the efficiency. Accordingly, by setting the first-blade-segment outlet angle α1 of the first blade segment 20 constant, the multi-blade centrifugal fan 5 can be improved in terms of efficiency, and noise thereof can be reduced.

Embodiment 2

A multi-blade centrifugal fan 5 according to Embodiment 2 will now be described with reference to FIG. 5.

Figure 5:
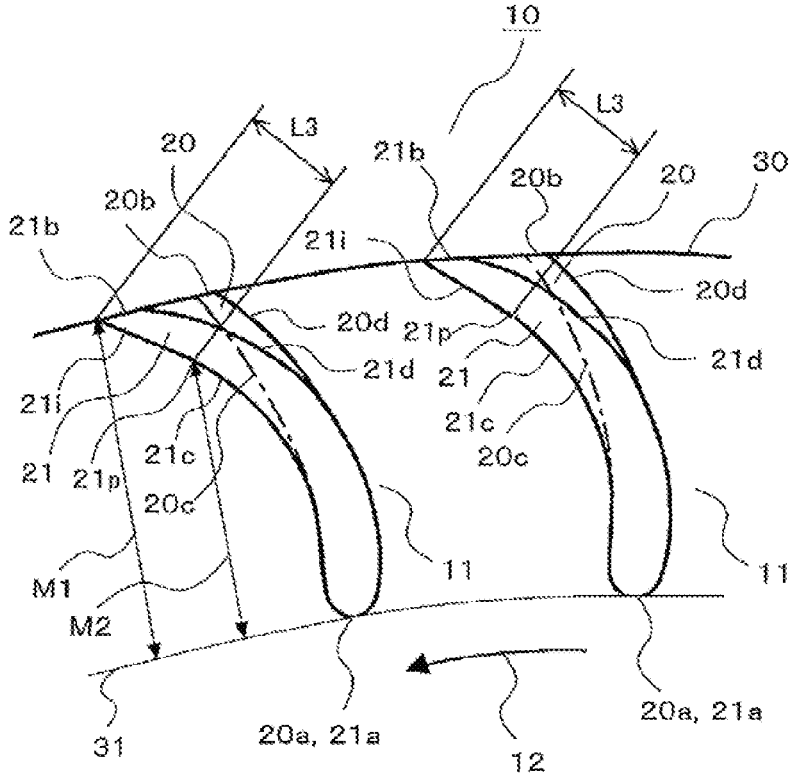
FIG. 5 is an enlarged view of blades according to Embodiment 2, viewed from the rim in the direction of the rotation axis J.

FIG. 5 is an enlarged view of blades according to Embodiment 2, viewed from the rim in the direction of the rotation axis J.

The basic structure of the multi-blade centrifugal fan according to Embodiment 2 including an impeller 10, a volute shaped casing 5*a*, and other components is similar to that in Embodiment 1, and description thereof is thus omitted.

<Structure of Blades 11>

The plurality of blades 11 have the same shape. Similar to Embodiment 1, as illustrated in FIG. 3, each blade 11 includes a first blade segment 20 adjacent to the backing plate 10*a* and a second blade segment 21 adjacent to the rim 10*b*. The first blade segment 20 and the second blade segment 21 may either be formed in one piece or be formed separately and combined together. The first blade segment 20 and the second blade segment 21 are connected to each other at a connecting portion 22.

As illustrated in FIG. 5, when each blade 11 is viewed in the direction of the rotation axis J, the first blade segment 20 and the second blade segment 21 have different attachment angles.

The first blade segment 20 is formed of a plate-shaped body that is parallel to the rotation axis J, and has a forward curved shape.

The second blade segment 21 is twisted from an end surface 21*e* adjacent to the rim 10*b* to be connected to the first blade segment 20.

The first blade segment 20 has a leading edge 20*a* at one end thereof at the inner periphery of the impeller 10, and a trailing edge 20*b* at the other end thereof at the outer periphery of the impeller 10. The first blade segment 20 also has a pressure surface 20*c*, which is a blade surface facing in the rotation direction 12, and a suction surface 20*d*, which is a blade surface facing in the direction opposite to the rotation direction 12.

The second blade segment 21 has a leading edge 21*a* at one end thereof at the inner periphery of the impeller 10, and a trailing edge 21*b* at the other end thereof at the outer periphery of the impeller 10.

The second blade segment 21 also has a pressure surface 21*c*, which is a blade surface facing in the rotation direction 12, and a suction surface 21*d*, which is a blade surface facing in the direction opposite to the rotation direction 12.

As illustrated in FIG. 5, the first blade segment 20 and the second blade segment 21 are formed so that, in a cross section perpendicular to the rotation axis J, the pressure surfaces 20*c* and 21*c* are concave surfaces including arcs and the suction surfaces 20*d* and 21*d* are convex surfaces including arcs. The trailing edges 20*b* and 21 *b* are in front of the leading edges 20*a* and 21*a* in the rotation direction 12.

The pressure surface 21*c* of the second blade segment 21 includes a first flat surface 21*i* that extends from the trailing edge 21*b* over a predetermined range in the radial direction. The first flat surface 21*i* extends from the trailing edge 21*b* to an inner end 21*p*.

The length L3 of the first flat surface 21*i* from the trailing edge 21*b* to the inner end 21*p* in the radial direction gradually increases with increasing distance from the connecting portion 22 toward the rim 10*b* in the direction of the rotation axis J.

Assuming that a second imaginary circle 31 is a path along which the leading edges 20*a* and 21*a* move, the length M2 between the second imaginary circle 31 and the inner end 21*p* in the radial direction around the rotation axis J is greater than ⅔ of the length M1 between the first imaginary circle 30 and the second imaginary circle 31 in the radial direction (M2>⅔×M1).

<Effects>

According to the multi-blade centrifugal fan 5 of Embodiment 2 having the above-described structure, the effects of Embodiment 1 can be obtained. In addition, the first flat surface 21*i* is formed on a part of the pressure surface 21*c* near the trailing edge 21*b* over the range in which the second-blade-segment outlet angle β1 is increased. Thus, when the blade 11 discharges air, the air flow can be stabilized by the first flat surface 21*i*. Accordingly, separation of the air flow is reduced, particularly at the second blade segment 21, and disturbance of the air flow is reduced. As a result, the multi-blade centrifugal fan 5 can be improved in terms of efficiency, and noise thereof can be reduced.

When the impeller 10 is formed by resin molding, mold pieces between the blades cannot be pulled out when the second-blade-segment outlet angle β1 is increased in the region on the side of the rim 10*b*. However, when the first flat surface 21*i* is formed, the mold pieces can be removed from the outer periphery. Accordingly, the backing plate 10*a*, the rim 10*b*, and the blades 11 can be molded in one piece.

When the backing plate 10*a* and the blades 11 are separately formed, the blades 11 and the rim 10*b* can be formed in one piece by using a two-piece mold, and the backing plate 10*a* and the blades 11 can be joined together by, for example, ultrasonic welding.

<Modification>

A multi-blade centrifugal fan 5 according to a modification of Embodiment 2 will now be described with reference to FIG. 6.

Figure 6:
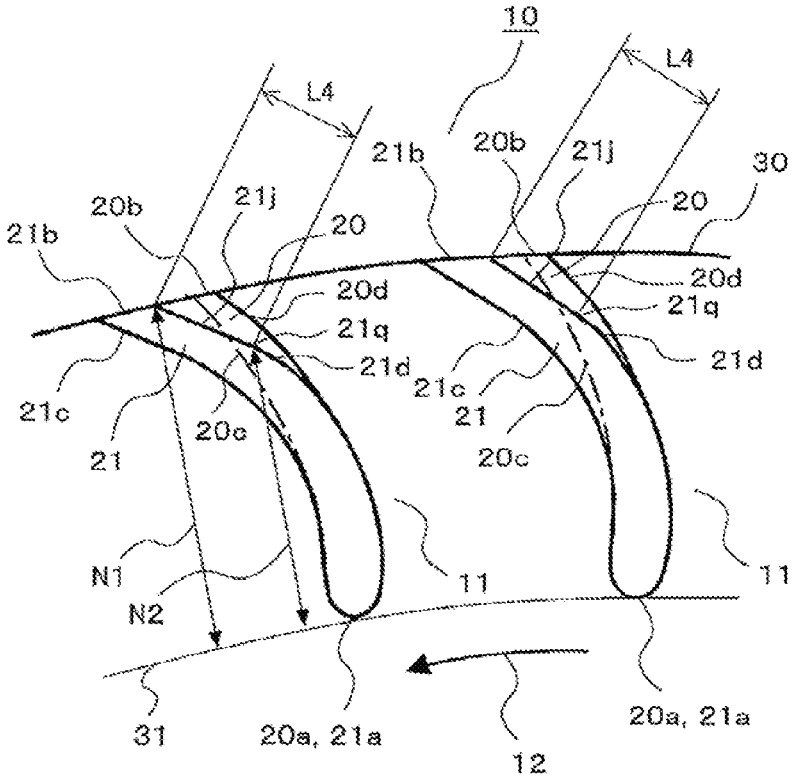
FIG. 6 is an enlarged view of blades according to a modification of Embodiment 2, viewed from the rim in the direction of the rotation axis J.

FIG. 6 is an enlarged view of blades according to a modification of Embodiment 2, viewed from the rim in the direction of the rotation axis J.

The basic structure of the multi-blade centrifugal fan according to a modification of Embodiment 2 including an impeller 10, a volute shaped casing 5*a*, and other components is similar to that in Embodiment 1, and description thereof is thus omitted.

In Embodiment 2, the pressure surface 21*c* of the second blade segment 21 includes the first flat surface 21*i* that extends from the trailing edge 21*b* over a predetermined range in the radial direction. In this modification, the suction surface 21*d* of the second blade segment 21 includes a second flat surface 21*j* that extends from the trailing edge 21*b* over a predetermined range in the radial direction. The second flat surface 21*j* extends from the trailing edge 21*b* to an inner end 21*q*.

The thickness of the blade 11 decreases with increasing distance toward the outer periphery along the second flat surface 21*j*.

The length L4 of the second flat surface 21*j* from the trailing edge 21*b* to the inner end 21*q* in the radial direction gradually increases with increasing distance from the connecting portion 22 toward the rim 10*b* in the direction of the rotation axis J.

Assuming that a second imaginary circle 31 is a path along which the leading edges 20*a* and 21*a* move, the length N2 between the second imaginary circle 31 and the inner end 21*q* in the radial direction around the rotation axis J is greater than ⅔ of the length N1 between the first imaginary circle 30 and the second imaginary circle 31 in the radial direction (N2>⅔×N1).

<Effects>

According to the multi-blade centrifugal fan 5 of the modification of Embodiment 2 having the above-described structure, even when the air flow is temporarily separated from the convex suction surface 21*d* of the second blade segment 21, the air flow easily comes into contact with the second flat surface 21*j*. Therefore, concentration of the air flow on the pressure surfaces 20*c* and 21*c*, which occurs when the air flow that has been separated from the suction surface 21*d* reaches the pressure surfaces 20*c* and 21*c*, can be reduced, and the air flow can be easily stabilized. Accordingly, the multi-blade centrifugal fan 5 can be improved in terms of efficiency, and noise thereof can be reduced.

The first flat surface 21*i* according to Embodiment 2 and the second flat surface 21*j* according to the modification may both be applied. In this case, it can be expected that the first flat surface 21*i* and the second flat surface 21*j* will provide a synergistic effect in reducing disturbance of the air flow.

The part of the blade 11 including both the first flat surface 21*i* and the second flat surface 21*j* may have a constant thickness. When the thickness is constant, the air flow can be regulated while the strength of the trailing edge 21*b* of the second blade segment 21 is maintained.

Embodiment 3

A multi-blade centrifugal fan 5 according to Embodiment 3 will now be described with reference to FIG. 7.

Figure 7:
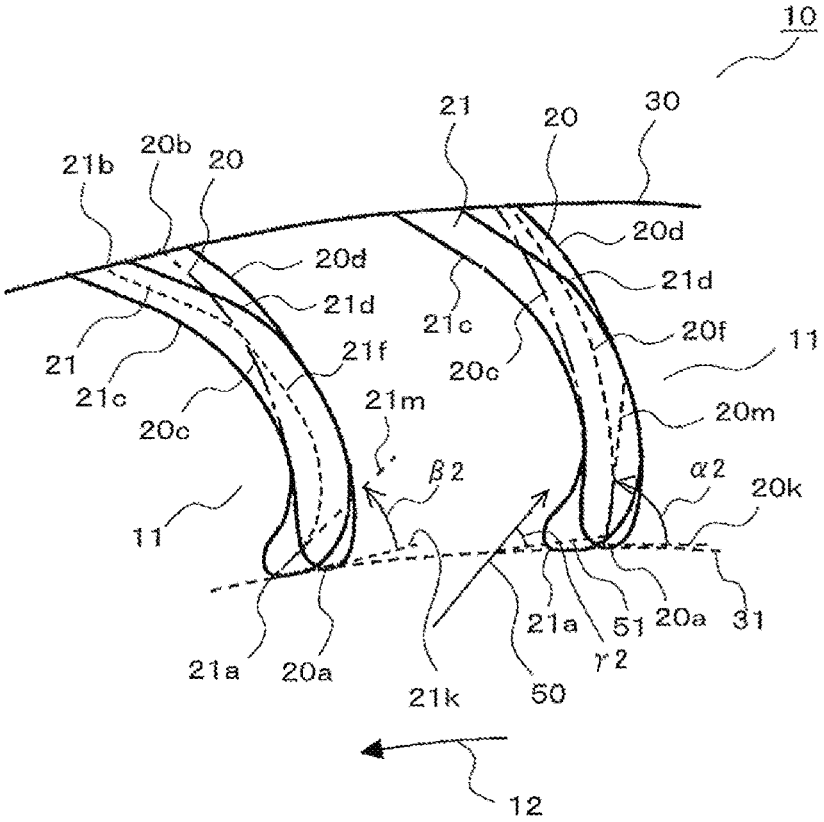
FIG. 7 is an enlarged view of blades according to Embodiment 3, viewed from the rim in the direction of the rotation axis J.

FIG. 7 is an enlarged view of blades according to Embodiment 3, viewed from the rim in the direction of the rotation axis J.

The basic structure of the multi-blade centrifugal fan according to Embodiment 3 including an impeller 10, a volute shaped casing 5*a*, and other components is similar to that in Embodiment 1, and description thereof is thus omitted.

<Structure of Blades 11>

The plurality of blades 11 have the same shape. As illustrated in FIG. 3, each blade 11 includes a first blade segment 20 adjacent to the backing plate 10*a* and a second blade segment 21 adjacent to the rim 10*b*. The first blade segment 20 and the second blade segment 21 may either be formed in one piece or be formed separately and combined together. The first blade segment 20 and the second blade segment 21 are connected to each other at a connecting portion 22.

As illustrated in FIG. 7, when each blade 11 is viewed in the direction of the rotation axis J, the first blade segment 20 and the second blade segment 21 have different shapes.

The first blade segment 20 is formed of a plate-shaped body that is parallel to the rotation axis J, and has a forward curved shape.

The second blade segment 21 is twisted from an end surface 21*e* adjacent to the rim 10*b* to be connected to the first blade segment 20.

As illustrated in FIG. 3, the length L1 of each blade 11 in the direction of the rotation axis J and the length L2 of the second blade segment 21 in the direction of the rotation axis J (length between the end surface 21*e* and the connecting portion 22) are set so that L2/L1 is less than or equal to ½.

The first blade segment 20 has a leading edge 20*a* at one end thereof at the inner periphery of the impeller 10, and a trailing edge 20*b* at the other end thereof at the outer periphery of the impeller 10. The first blade segment 20 also has a pressure surface 20*c*, which is a blade surface facing in the rotation direction 12, and a suction surface 20*d*, which is a blade surface facing in the direction opposite to the rotation direction 12.

The second blade segment 21 has a leading edge 21*a* at one end thereof at the inner periphery of the impeller 10, and a trailing edge 21*b* at the other end thereof at the outer periphery of the impeller 10. The second blade segment 21 also has a pressure surface 21*c*, which is a blade surface facing in the rotation direction 12, and a suction surface 21*d*, which is a blade surface facing in the direction opposite to the rotation direction 12.

As illustrated in FIG. 7, the first blade segment 20 and the second blade segment 21 are formed so that, in a cross section perpendicular to the rotation axis J, the pressure surfaces 20*c* and 21*c* are concave surfaces including arcs and the suction surfaces 20*d* and 21*d* are convex surfaces including arcs. The trailing edges 20*b* and 21 *b* are in front of the leading edges 20*a* and 21*a* in the rotation direction 12. This shape of the blade 11 is defined as a forward curved shape, and is commonly used as the shape of blades of a sirocco fan.

<First-Blade-Segment Inlet Angle α2 and Second-Blade-Segment Inlet Angle β2>

The definition of a first-blade-segment inlet angle α2 and a second-blade-segment inlet angle β2 at the leading edges 20*a* and 21*a* will now be described.

As illustrated in FIG. 7, the first-blade-segment inlet angle α2 is defined as the angle between a tangent 20*m* of a first-blade-segment center line 20*f*, which passes through the center of the first blade segment 20 in the thickness direction, and a tangent 20*k* of a second imaginary circle 31, along which the leading edge 20*a* moves, at the leading edge 20*a*. Referring to FIG. 7, the first-blade-segment inlet angle α2 is the counterclockwise rotation angle from the tangent 20*k* of the second imaginary circle 31 to the tangent 20*m* of the first-blade-segment center line 20*f*.

As illustrated in FIG. 7, the second-blade-segment inlet angle β2 is defined as the angle between a tangent 21*m* of a second-blade-segment center line 21*f*, which passes through the center of the second blade segment 21 in the thickness direction, and a tangent 21*k* of the second imaginary circle 31, along which the leading edge 21*a* moves, at the leading edge 21*a*. Referring to FIG. 7, the second-blade-segment inlet angle β2 is the counterclockwise rotation angle from the tangent 21*k* of the second imaginary circle 31 to the tangent 21*m* of the second-blade-segment center line 21*f*.

The first-blade-segment inlet angle α2 is constant in the direction of the rotation axis J. The second-blade-segment inlet angle β2 is at a minimum at the end surface 21*e*, and gradually increases to the first-blade-segment inlet angle α2 with increasing distance toward the connecting portion 22 between the second blade segment 21 and the first blade segment 20. In other words, the second-blade-segment inlet angle β2 is constantly smaller than the first-blade-segment inlet angle α2. The range in the direction of the rotation axis J in which the second-blade-segment inlet angle β2 of the second blade segment 21 is set to be smaller than the first-blade-segment inlet angle α2 is the same as the range in which the outlet angle of the second-blade-segment outlet angle β1 is set to be greater than the first-blade-segment outlet angle α1 in Embodiment 1.

The leading edge 21*a* of the second blade segment 21 is in front of the leading edge 20*a* of the corresponding first blade segment 20 in the rotation direction 12.

<Effects>

In the multi-blade centrifugal fan 5 according to Embodiment 3 having the above-described structure, as illustrated in FIG. 7, an air inflow angle γ2 is defined as the angle between the direction in which introduced air 50 flows at the second imaginary circle 31, along which the leading edges 20*a* and 21*a* move, and a tangent 51 of the second imaginary circle 31. Accordingly, the difference between the second-blade-segment inlet angle β2 of the second blade segment 21 and the inflow angle γ2 is reduced at the second blade segment 21 in the region on the side of the rim 10*b*, where the air flow rate and the inflow angle γ2 of the air flow are smaller than those in the region near the backing plate 10*a*. Therefore, separation of the air flow does not easily occur at the suction surface 21*d* around the leading edge 21*a* of the second blade segment 21. In addition, concentration of the air flow on the pressure surfaces 20*c* and 21*c*, which occurs when the air flow that has been separated from the leading edge 21*a* reaches the pressure surfaces 20*c* and 21*c*, can be reduced, and the air flow can be easily stabilized. Accordingly, the multi-blade centrifugal fan 5 can be improved in terms of efficiency, and noise thereof can be reduced.

Embodiment 4

A multi-blade centrifugal fan 5 according to Embodiment 4 will be described with reference to FIG. 8.

Figure 8:
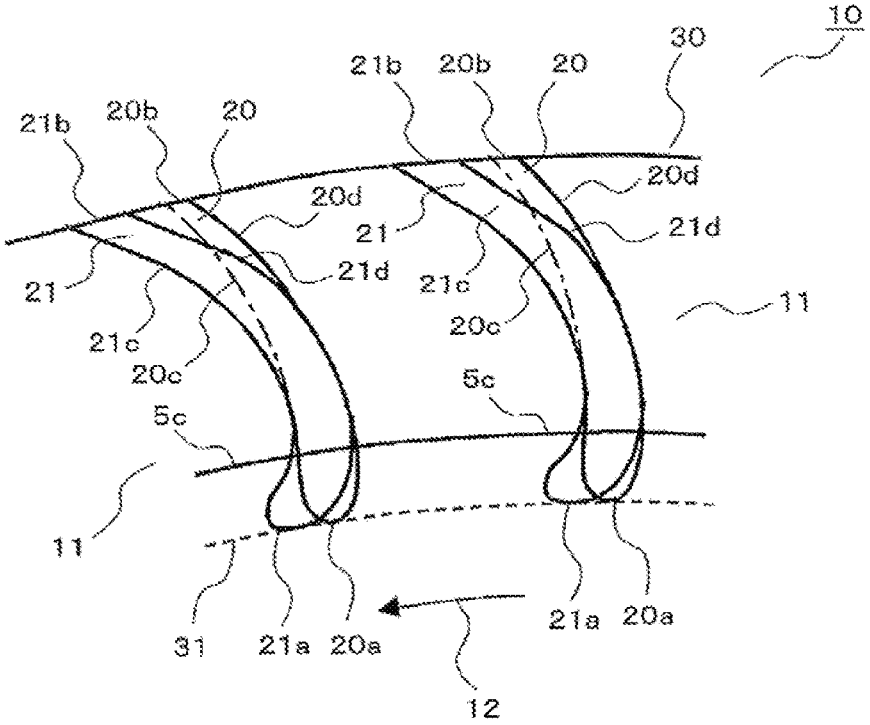
FIG. 8 is an enlarged view of blades according to Embodiment 4, viewed from the rim in the direction of the rotation axis J.

FIG. 8 is an enlarged view of blades according to Embodiment 4, viewed from the rim in the direction of the rotation axis J.

The basic structure of the multi-blade centrifugal fan according to Embodiment 4 including an impeller 10, a volute shaped casing 5*a*, and other components is similar to that in Embodiment 1, and description thereof is thus omitted.

In the multi-blade centrifugal fan 5 according to Embodiment 4, a minimum inner diameter 5*c* of the bell mouth 5*b* is greater than the diameter of the second imaginary circle 31 along which the leading edges 20*a* and 21*a* move.

<Effects>

According to the multi-blade centrifugal fan 5 of Embodiment 4 having the above-described structure, the effects of the multi-blade centrifugal fan 5 according to Embodiment 1 can be obtained. In addition, air additionally flows into the spaces between the blades 11 from the side at which the end surfaces 21*e* of the blades 11 are disposed. Accordingly, the amount of air that flows between the second blade segments 21 increases. As a result, the air flow is not easily separated from the pressure surfaces 20*c* and 21*c* of the blades 11 at the trailing edges 20*b* and 21 *b*, and disturbance of the air flow can be suppressed.

Embodiment 5

A multi-blade centrifugal fan 5 according to Embodiment 5 will be described with reference to FIGS. 9 and 10.

Figure 9:
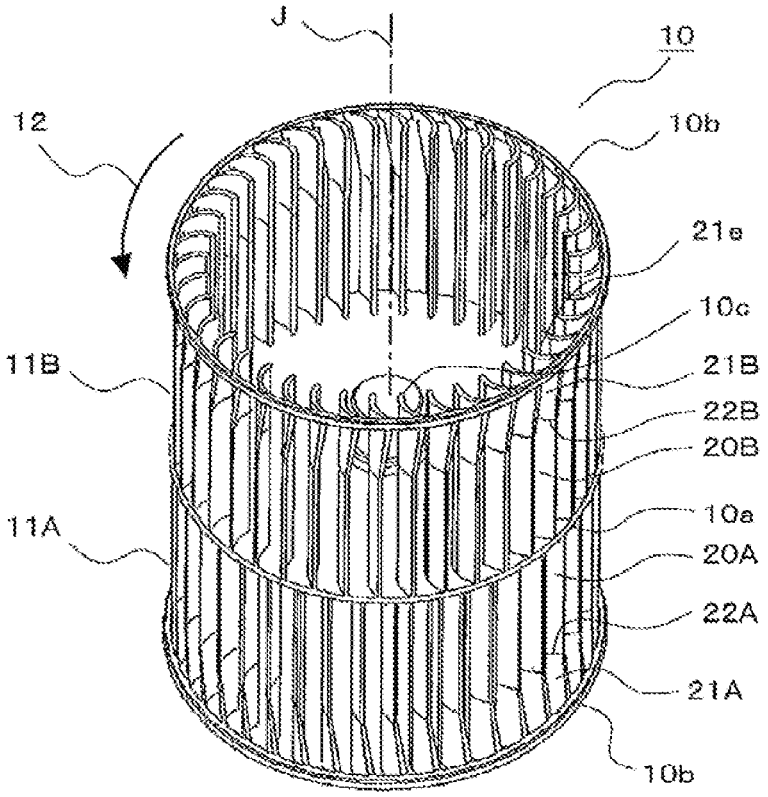
FIG. 9 is a perspective view of a multi-blade centrifugal fan according to Embodiment 5.

FIG. 9 is a perspective view of the multi-blade centrifugal fan according to Embodiment 5.

Figure 10:
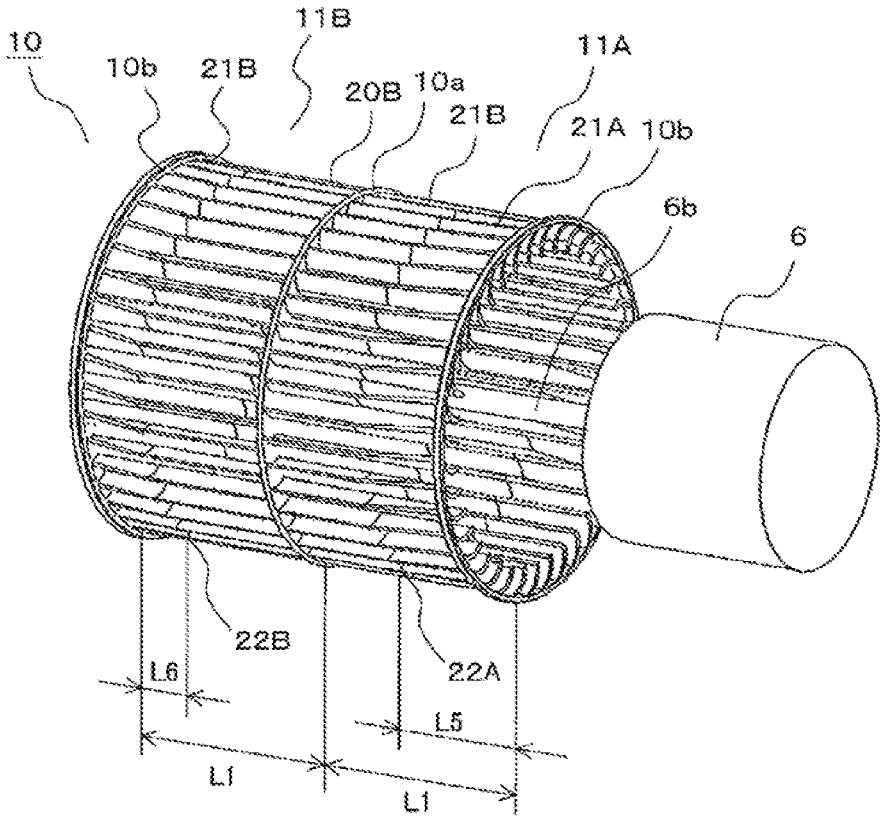
FIG. 10 is a perspective view of the multi-blade centrifugal fan according to Embodiment 5 viewed from a different angle.

FIG. 10 is a perspective view of the multi-blade centrifugal fan according to Embodiment 5 viewed from a different angle.

<Structure of Impeller 10>

As illustrated in FIGS. 9 and 10, the impeller 10 of the multi-blade centrifugal fan 5 has a cylindrical shape and includes a disk-shaped backing plate 10*a* and two ring-shaped rims 10*b* disposed on both sides of the backing plate 10*a* that extend in parallel. The impeller 10 rotates around the rotation axis J in a rotation direction 12.

A plurality of blades 11 extend parallel to the rotation axis J between the outer periphery of the backing plate 10*a* and the two rims 10*b*. The blades 11 are arranged to surround the rotation axis J of the impeller 10.

The backing plate 10*a* includes a boss portion 10*c* on the rotation axis J. The boss portion 10*c* is connected to the rotation shaft 6*b* of the fan motor 6. As illustrated in FIG. 10, the fan motor 6 is disposed near one of the two rims 10*b*.

The impeller 10 is attached to the volute shaped casing 5*a* so that the two rims 10*b* oppose their respective bell mouths 5*b* disposed on two opposing surfaces of the volute shaped casing 5*a*. Accordingly, the air sucked into the volute shaped casing 5*a* through the bell mouths 5*b* flows into the impeller 10 from opposite sides of the two rims 10*b*.

The impeller 10 may either be formed in one piece by resin molding, or be formed by separately preparing the backing plate 10*a*, the rims 10*b*, and the blades 11 and assembling them together. The impeller 10 may be made of any appropriate material selected from, for example, resins and various types of metals.

<Structure of Blades>

The plurality of blades 11 include blades A (11A) disposed on one side of the backing plate 10*a* and having the same shape and blades B (11B) disposed on the other side of the backing plate 10*a* and having the same shape. As illustrated in FIG. 9, each blade A (11A) includes a first blade segment 20A adjacent to the backing plate 10*a* and a second blade segment 21A adjacent to the corresponding rim 10*b*. As illustrated in FIG. 9, each blade B (11B) includes a first blade segment 20B adjacent to the backing plate 10*a* and a second blade segment 21B adjacent to the corresponding rim 10*b*. The first blade segment 20A and the second blade segment 21A are connected to each other at a connecting portion 22A. The first blade segment 20B and the second blade segment 21B are connected to each other at a connecting portion 22B.

The first blade segments 20A and 20B and the second blade segments 21A and 21B have different attachment angles when viewed in the direction of the rotation axis J.

The first blade segments 20A and 20B are formed of plate-shaped bodies that are parallel to the rotation axis J, and have a forward curved shape.

The second blade segments 21A and 21B are twisted from the end surfaces 21*e* adjacent to the rims 10*b* to be connected to the first blade segments 20A and 20B.

As illustrated in FIG. 10, the length L5 of the second blade segment 21A of each blade A (11A) in the direction of the rotation axis J is greater than the length L6 of the second blade segment 21B of each blade B (11B) in the direction of the rotation axis J.

The fan motor 6 is disposed near the blades A (11A).

The structures of the first blade segments 20A and 20B, which have the first-blade-segment outlet angle α1, and the second blade segments 21A and 21B, which have the second-blade-segment outlet angle β1, are similar to those in Embodiment 1, and description thereof is thus omitted.

<Effects>

The multi-blade centrifugal fan 5 according to Embodiment 5 having the above-described structure provides the following effects. In a double-suction multi-blade centrifugal fan that sucks air from both sides of the backing plate 10*a*, the air flow resistance is large at the side at which the fan motor 6 is installed. Accordingly, the length in the direction of the rotation axis J over which the difference between the second-blade-segment outlet angle β1 and the discharge angle γ1 is large is increased in the region near the fan motor where the blades A (11A) are disposed. Therefore, the length L5 of the second blade segment 21A is set to be greater than the length L6 of the second blade segment 21B at the other side, so that the difference between the second-blade-segment outlet angle β1 and the discharge angle γ1 can be reduced at the second blade segment 21A. Accordingly, separation of the air flow is reduced, particularly at the second blade segment 21A, and disturbance of the air flow is reduced. As a result, the multi-blade centrifugal fan 5 can be improved in terms of efficiency, and noise thereof can be reduced.

Embodiment 6

Figure 11:
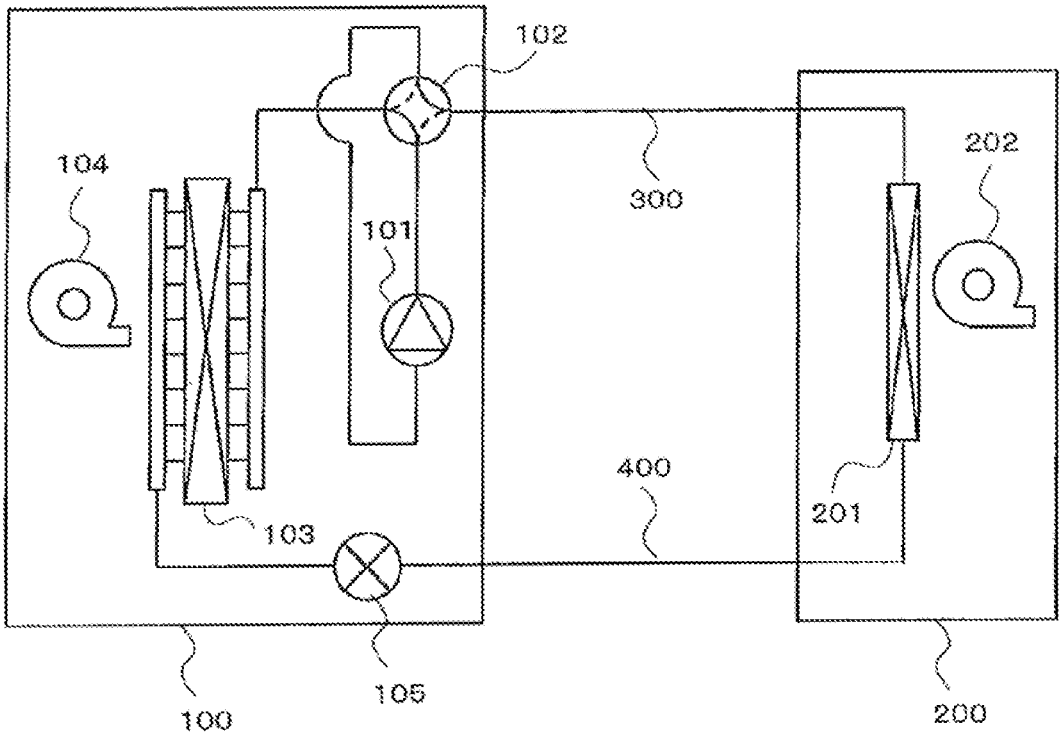
FIG. 11 is a block diagram of an air-conditioning apparatus according to Embodiment 6.

FIG. 11 is a block diagram of an air-conditioning apparatus according to Embodiment 6.

The air-conditioning apparatus according to Embodiment 6, which includes an indoor unit 200 including the above-described multi-blade centrifugal fan 5, will now be described.

The air-conditioning apparatus includes an outdoor unit 100 and the indoor unit 200, which are connected by refrigerant pipes to constitute a refrigerant circuit. The refrigerant pipes include a gas pipe 300 through which gas refrigerant flows and a liquid pipe 400 through which liquid refrigerant or two-phase gas-liquid refrigerant flows.

In Embodiment 7, the outdoor unit 100 includes a compressor 101, a four-way valve 102, an outdoor side heat exchanger 103, an outdoor side blower 104, and an expansion device (expansion valve) 105.

The compressor 101 sucks gas refrigerant and discharges the refrigerant after compressing the refrigerant. The compressor 101 includes, for example, an inverter device, and the capacity (amount of refrigerant discharged per unit time) of the compressor 101 can be changed by appropriately changing the operation frequency. The four-way valve 102 changes the flow of the refrigerant between a cooling operation and a heating operation in response to an instruction from a controller (not shown).

The outdoor side heat exchanger 103 exchanges heat between the refrigerant and outside air. In, for example, a heating operation, the outdoor side heat exchanger 103 functions as an evaporator and evaporates the refrigerant by exchanging heat between low-pressure refrigerant that flows from the liquid pipe 400 and air. In a cooling operation, the outdoor side heat exchanger 103 functions as a condenser, and condenses the refrigerant by exchanging heat between the refrigerant compressed by the compressor 101 and air.

The outdoor side blower 104 is disposed near the outdoor side heat exchanger 103 to increase the efficiency of heat exchange between the refrigerant and air. The multi-blade centrifugal fan 5 described in any of Embodiments 1 to 6, for example, may be used as the outdoor side blower 104. The outdoor side blower 104 may be configured so that the rotational speed of the multi-blade centrifugal fan 5 can be changed by appropriately changing the operation frequency of the fan motor 6 by using an inverter device. The expansion device 105 adjusts the difference in refrigerant pressure thereacross by changing the opening degree.

The indoor unit 200 includes a load side heat exchanger 201 and a load side blower 202. The load side heat exchanger 201 exchanges heat between the refrigerant and inside air. In, for example, a heating operation, the load side heat exchanger 201 functions as a condenser. The load side heat exchanger 201 exchanges heat between the refrigerant from the gas pipe 300 and air to condense the refrigerant, and discharges the refrigerant to the liquid pipe 400. In a cooling operation, the load side heat exchanger 201 functions as an evaporator. The load side heat exchanger 201 exchanges heat between, for example, the refrigerant set to a low pressure state by the expansion device 105 and air to evaporate the liquid refrigerant, and discharges the refrigerant to the gas pipe 300. The indoor unit 200 includes the load side blower 202 for adjusting the flow rate of the air subjected to heat exchange. The operation speed of the load side blower 202 is determined by, for example, the user's settings. The multi-blade centrifugal fan 5 described in any of Embodiments 1 to 6, for example, may be used as the load side blower 202.

<Effects>

As described above, in the air-conditioning apparatus according to Embodiment 6, the multi-blade centrifugal fan 5 described in any of Embodiments 1 to 5 may be used as the outdoor unit 100 and the indoor unit 200. Thus, a highly efficient air-conditioning apparatus with less noise can be obtained.

Although the present invention has been described in detail by way of preferred embodiments, it is obvious that various modifications can be made by a person skilled in the art based on the basic technical idea and teachings of the present invention.

The structures of the multi-blade centrifugal fans 5 described in Embodiments 1 to 6 may be applied in combination as appropriate.

The blowers according to Embodiments 1 to 6 of the invention have the following configurations.

(1) A blower includes a volute shaped casing 5*a* having an air inlet, and an impeller 10 including a disk-shaped backing plate 10*a*, a ring-shaped rim 10*b*, and a plurality of blades 11 supported between the backing plate 10*a* and the rim 10*b*. The impeller 10 is housed in the casing 5*a*, each of the blades 11 including a first blade segment 20 adjacent to the backing plate 10*a*, and a second blade segment provided between the first blade segment and the rim. Each of the blades 11 has a blade outlet angle β1 at a trailing edge 21*b* of the second blade segment 21 being different from a blade outlet angle α1 at a trailing edge 20*b* of the first blade segment 20. At least one of a pressure surface 21*c* of the second blade segment 21 and a suction surface 21*d* of the second blade segment 21 includes a flat surface 21*i*, 21*j* extending toward a leading edge 21*a* of the second blade segment from the trailing edge 21*b* of the second blade segment. Thus, when the blade 11 discharges air, the air flow can be stabilized by the flat surface 21*i*, 21*j*. Accordingly, separation of the air flow is reduced, particularly at the second blade segment 21, and disturbance of the air flow is reduced. As a result, the multi-blade centrifugal fan 5 can be improved in terms of efficiency, and noise thereof can be reduced.

(2) In the blower of (1), the flat surface 21*i* is provided on the pressure surface 21*c* of the second blade segment 21.

(3) In the blower of (1), the flat surface 21*j* is provided on the suction surface 21*d* of the second blade segment 21.

(4) In the blower of (1), the flat surface 21*i*, 21*j* is provided on each of the pressure surface 21*c* and the suction surface 21*d* of the second blade segment 21. In the blowers (2) to (4), the air flow can be stabilized by forming the flat surface 21*i*, 21*j* on one or both of the pressure surface 21*c* and the suction surface 21*d* of each blade 11. Accordingly, separation of the air flow is reduced, particularly at the second blade segment 21, and disturbance of the air flow is reduced. As a result, the multi-blade centrifugal fan 5 can be improved in terms of efficiency, and noise thereof can be reduced.

(5) In the blower of (4), the second blade segment 21 has a constant thickness along the flat surface 21*i*, 21*j*. Thus, the air flow can be regulated, and the strength of the trailing edge 21*b* of the second blade segment 21 can be maintained.

(6) In the blower of any one of (2) to (5), a length of the flat surface 21*i*, 21*j* in a radial direction of the impeller 10 gradually increases with increasing distance from a side adjacent to the backing plate 10*a* toward the rim 10*b* in a direction of a rotation axis J of the impeller 10. Thus, the length of the flat surface 21*i*, 21*j* in the radial direction is increased at a part of the second blade segment 21 on the side of the rim 10*b*, where the air flow is easily disturbed. Accordingly, the air flow can be stabilized.

(7) In the blower of any one of (1) to (6), the blade outlet angle β1 of the second blade segment is greater than the blade outlet angle α1 of the first blade segment. Accordingly, the difference between the discharge angle γ1 and the blade outlet angle β1 of the second blade segment is reduced at a part of each blade 11 on the side of the rim 10*b*, where the air discharge angle γ1 is large, so that separation of the air flow can be prevented. Thus, the multi-blade centrifugal fan 5 can be improved in terms of efficiency, and noise thereof can be reduced.

(8) In the blower of any one of (1) to (7), the blade outlet angle α1 of the first blade segment is constant in a direction of a rotation axis J of the impeller. Thus, air can be efficiently conveyed without causing separation of the air flow from the surface of each blade 11 at a part of the blade 11 near the backing plate 10*a*, where the discharge angle γ1 is stable.

(9) In the blower of any one of (1) to (8), the blade outlet angle β1 of the second blade segment gradually decreases with increasing distance from a side of the second blade segment 21 adjacent to the rim 10*b* toward the backing plate 10*a*. Thus, the blade outlet angle β1 of the second blade segment can be increased, particularly in a region on the side of the rim 10*b* where the discharge angle γ1 is large, so that separation of the air flow can be prevented. Thus, the multi-blade centrifugal fan 5 can be improved in terms of efficiency, and noise thereof can be reduced.

(10) In the blower of any one of (1) to (9), a blade inlet angle β2 at the leading edge 21*a* of the second blade segment 21 is different from a blade inlet angle α2 at a leading edge 20*a* of the first blade segment 20. Accordingly, separation of the air flow can be prevented over the entire surface of each blade 11 in accordance with the difference in the air inflow angle γ2 between the part of the blade 11 adjacent to the backing plate 10*a* and the part of the blade 11 on the side of the rim 10*b*.

(11) In the blower of (10), the blade inlet angle β2 of the second blade segment is smaller than the blade inlet angle α2 of the first blade segment. Accordingly, the difference between the inflow angle γ2 and the blade inlet angle β2 of the second blade segment is made large at a part of each blade 11 on the side of the rim 10*b*, where the air inflow angle γ2 is large, so that separation of the air flow can be prevented. Thus, the multi-blade centrifugal fan 5 can be improved in terms of efficiency, and noise thereof can be reduced.

(12) In the blower of (10) or (11), the blade inlet angle β2 of the second blade segment gradually increases with increasing distance from a side of the second blade segment 21 adjacent to the rim 10*b* toward the backing plate 10*a*. Thus, the blade inlet angle β2 of the second blade segment can be made smaller, particularly in a region on the side of the rim 10*b* where the inflow angle γ2 is small, so that separation of the air flow can be prevented. Thus, the multi-blade centrifugal fan 5 can be improved in terms of efficiency, and noise thereof can be reduced.

(13) In the blower of any one of (1) to (12), the air inlet of the volute shaped casing 5*a* has a bell mouth 5*b*, and the bell mouth 5*b* has a minimum diameter larger than a diameter of a second imaginary circle 31 along which the leading edge 21*a* of the second blade segment 21 moves. Accordingly, air additionally flows into the spaces between the blades 11 from the side at which the end surfaces 21*e* of the blades 11 are disposed, and the amount of air that flows between the second blade segments 21 increases. As a result, the air flow is not easily separated from the pressure surfaces 20*c* and 21*c* of the blades 11 at the trailing edges 20*b* and 21*b*, and disturbance of the air flow can be suppressed.

(14) In the blower of any one of (1) to (13), the impeller 10 includes the backing plate 10*a* disposed at a center, a pair of the rims 10*b* disposed on both sides of the backing plate 10*a*, the plurality of blades 11 supported between the backing plate 10*a* and one of the pair of the rims 10*b*, and the plurality of blades 11 supported between the backing plate 10*a* and an other of the pair of the rims 10*b*. A fan motor 6 that rotates the impeller 10 is disposed near the one of the pair of the rims 10*b*. A length of the second blade segment 21 adjacent to the one of the pair of the rims 10*b* in a direction of a rotation axis J is greater than a length of the second blade segment 21 adjacent to the other of the pair of the rims 10*b* in the direction of the rotation axis J.

In a double-suction multi-blade centrifugal fan that sucks air from both sides of the backing plate 10*a*, the air flow resistance is large at the side at which the fan motor 6 is installed. Accordingly, the length in the direction of the rotation axis J over which the difference between the blade outlet angle β1 of the second blade segment and the discharge angle γ1 is large is increased in the region near the fan motor 6. Therefore, referring to FIG. 10, the length L5 of the second blade segment 21A is set to be greater than the length L6 of the second blade segment 21B at the other side, so that the difference between the blade outlet angle β1 of the second blade segment 21A and the discharge angle γ1 can be reduced. Accordingly, separation of the air flow is reduced, particularly at the second blade segment 21A, and disturbance of the air flow is reduced. As a result, the multi-blade centrifugal fan 5 can be improved in terms of efficiency, and noise thereof can be reduced.

(15) An air-conditioning apparatus includes the blower of any one of (1) to (14). Thus, a highly efficient air-conditioning apparatus with less noise can be obtained.

The invention claimed is:

1. A blower comprising:

a volute shaped casing having an air inlet; and an impeller including a disk-shaped backing plate, a ring-shaped rim, and a plurality of blades supported between the backing plate and the rim, the impeller being housed in the casing, each of the blades including a first blade segment adjacent to the backing plate, and a second blade segment provided between the first blade segment and the rim, each of the blades having a blade outlet angle at a trailing edge of the second blade segment being different from a blade outlet angle at a trailing edge of the first blade segment, at least one of a pressure surface of the second blade segment and a suction surface of the second blade segment including a flat surface extending toward a leading edge of the second blade segment from the trailing edge of the second blade segment.

2. The blower of claim 1, wherein the flat surface is provided on the pressure surface of the second blade segment.

3. The blower of claim 1, wherein the flat surface is provided on the suction surface of the second blade segment.

4. The blower of claim 1, wherein the flat surface is provided on each of the pressure surface and the suction surface of the second blade segment.

5. The blower of claim 4, wherein the second blade segment has a constant thickness along the flat surface.

6. The blower of claim 2, wherein a length of the flat surface in a radial direction of the impeller gradually increases with increasing distance from a side adjacent to the backing plate toward the rim in a direction of a rotation axis of the impeller.

7. The blower of claim 1, wherein the blade outlet angle of the second blade segment is greater than the blade outlet angle of the first blade segment.

8. The blower of claim 1, wherein the blade outlet angle of the first blade segment is constant in a direction of a rotation axis of the impeller.

9. The blower of claim 1, wherein the blade outlet angle of the second blade segment gradually decreases with increasing distance from a side of the second blade segment adjacent to the rim toward the backing plate.

10. The blower of claim 1, wherein a blade inlet angle at the leading edge of the second blade segment is different from a blade inlet angle at a leading edge of the first blade segment.

11. The blower of claim 10, wherein the blade inlet angle of the second blade segment is smaller than the blade inlet angle of the first blade segment.

12. The blower of claim 10, wherein the blade inlet angle of the second blade segment gradually increases with increasing distance from a side of the second blade segment adjacent to the rim toward the backing plate.

13. The blower of claim 1, wherein the air inlet of the volute shaped casing has a bell mouth, the bell mouth having a minimum diameter greater than a diameter of an imaginary circle along which the leading edge of the second blade segment moves.

14. The blower of claim 1, wherein the impeller includes the backing plate disposed at a center, a pair of the rims disposed on both sides of the backing plate, the plurality of blades supported between the backing plate and one of the pair of the rims, and the plurality of blades supported between the backing plate and an other of the pair of the rims, a fan motor that rotates the impeller and that is disposed on a side of the one of the pair of the rims, a length of the second blade segment adjacent to the one of the pair of the rims in a direction of a rotation axis being greater than a length of the second blade segment adjacent to the other of the pair of the rims in the direction of the rotation axis.

15. An air-conditioning apparatus comprising:

the blower of claim 1.

16. The blower of claim 1, wherein the flat surface extends from the trailing edge to an inner end, and a concave surface or a convex surface extends from the inner end to the leading edge of the second blade segment.

* * * * *